US007716010B2

(12) United States Patent
Pelletier

(10) Patent No.: US 7,716,010 B2
(45) Date of Patent: May 11, 2010

(54) SYSTEM, METHOD AND KIT FOR MEASURING A DISTANCE WITHIN A RAILROAD SYSTEM

(75) Inventor: Brad Pelletier, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 148 days.

(21) Appl. No.: 12/019,200

(22) Filed: Jan. 24, 2008

(65) Prior Publication Data

US 2009/0192758 A1 Jul. 30, 2009

(51) Int. Cl.
*G01B 5/02* (2006.01)
*G01N 29/04* (2006.01)

(52) U.S. Cl. ..... 702/158; 73/636

(58) Field of Classification Search ..... 702/158, 702/149–153, 155, 157, 159, 33–36, 39, 702/81, 84, 85, 94, 95, 97, 103, 105, 127, 702/166, 171, 182–184; 701/19; 246/2 F, 246/167 D, 167 R, 169 S, 170–171, 176, 246/191, 201; 104/31, 41, 43; 105/26.05, 105/96, 96.1; 73/632, 633, 636
See application file for complete search history.

(56) References Cited

U.S. PATENT DOCUMENTS 4,155,526 A * 5/1979 Noble ..... 246/249
4,554,624 A * 11/1985 Wickham et al. ..... 702/33
4,866,642 A * 9/1989 Obrig et al. ..... 702/157
5,129,606 A * 7/1992 Rodems et al. ..... 246/249
5,189,798 A 3/1993 La Force
5,654,510 A 8/1997 Schneider
5,848,476 A 12/1998 Grady (Continued)

FOREIGN PATENT DOCUMENTS

DE 195 10 560 9/1996

(Continued)

OTHER PUBLICATIONS

Lewis, R.B., Track-Recording Techniques Used on British Rail, IEE Proceedings, May 1984, vol. 131, No. 3, Surrey, Great Britain.

*Primary Examiner*—Michael P. Nghiem
*Assistant Examiner*—Toan M Le
(74) *Attorney, Agent, or Firm*—Robert Wawrzyn, Esq.; Cian G. O'Brien, Esq.; Beusse Wolter Sanks Mora & Maire, P.A.

(57) ABSTRACT

A system is provided for measuring a distance within a railroad system. The railroad system includes a rail vehicle having a plurality of pairs of wheels, where the plurality of pairs of wheels are in respective contact with a pair of rails. The system further includes a transducer positioned on an outer surface location of the rail vehicle. The transducer is configured to emit a signal to an object located the distance away from the transducer. The transducer is configured to receive the signal having reflected from the object along the distance to the transducer. The system further includes a controller coupled to the transducer to receive transmission and reception data of the signal to determine the distance. A method is also provided for measuring a distance within a railroad system, as well as a kit for converting a rail vehicle from a first configuration to a second configuration.

17 Claims, 6 Drawing Sheets

U.S. PATENT DOCUMENTS

| | | | | |
|---|---|---|---|---|
| 5,864,065 | A | 1/1999 | Prorok et al. | |
| 6,163,755 | A * | 12/2000 | Peer et al. | 701/301 |
| 6,323,441 | B1 | 11/2001 | Hager et al. | |
| 6,516,668 | B2 * | 2/2003 | Havira et al. | 73/636 |
| 6,995,556 | B2 * | 2/2006 | Nejikovsky et al. | 324/217 |
| 7,081,824 | B2 * | 7/2006 | Gilbert | 340/686.2 |
| 7,089,150 | B2 | 8/2006 | Phillips, III | |
| 2004/0122569 | A1 | 6/2004 | Bidaud | |
| 2004/0263624 | A1 * | 12/2004 | Nejikovsky et al. | 348/148 |
| 2006/0098843 | A1 * | 5/2006 | Chew | 382/103 |
| 2007/0217670 | A1 * | 9/2007 | Bar-Am | 382/141 |

FOREIGN PATENT DOCUMENTS

| | | |
|---|---|---|
| DE | 198 27 271 | 12/1999 |
| WO | WO 2005/025962 | 3/2005 |
| WO | WO 2005/036199 | 4/2005 |
| WO | WO 2008/146151 | 12/2008 |

* cited by examiner

SYSTEM, METHOD AND KIT FOR MEASURING A DISTANCE WITHIN A RAILROAD SYSTEM

BACKGROUND OF THE INVENTION

The present invention relates to railroad systems, and more particularly, to a system and method for measuring a distance within a railroad system. In railroad systems, such as those including a locomotive traveling along a pair of rails, for example, various distance parameters should be monitored to ensure proper operation of the railroad system. The monitoring of these distances have varying applications. For example, when a locomotive is reversing toward an object positioned in the reversal direction, the distance between the back end of the locomotive and the object should be monitored to ensure that the locomotive does not make unintended contact with the object. In another application of monitoring distance parameters during the operation of a railroad system, relative distance shifts of the rails during operation of the railroad system may be monitored to guard against possible derailment.

As illustrated in FIG. 1, in conventional railroad systems, a truck 11 is employed to travel over a pair of rails, and includes a phased array 13 (FIG. 2) adjacent an undersurface of the truck 11 which is contacted against a respective rail 15 as the truck 11 travels over the pair of rails. As shown in FIG. 3, the phased array 13 of the truck 11 emits a plurality of radio frequency signals 17, which subsequently deflect from an imperfection 19 within the rail 15 and are detected by a detection mechanism 21. Although FIG. 3 illustrates an imperfection 19 located within one particular location of the rail 15, the imperfection 19 may be located at any location within the rail 15. Once the truck 11 has finished traveling over the rail 15, data supplied from the detection mechanism 21 provides a detailed analysis of imperfections 19 within the rail 15 at each location along the rail 15.

Although conventional railroad systems provide a truck (or similar vehicle) to travel over a pair of rails and provide a detailed analysis of the imperfections within the rail, such railroad systems neither provide an analysis of relative distance shifts of the rails as an indication of possible derailment, nor provide such an analysis under real operating conditions. Thus, it would be advantageous to provide a system for measuring distances related to the locomotive traveling along the rail under real locomotive operating conditions.

BRIEF DESCRIPTION OF THE INVENTION

One embodiment of the present invention provides a combination of a railroad system and a system for measuring a distance on the railroad system. The combination includes a rail vehicle having a plurality of pairs of wheels, where the plurality of pairs of wheels are in respective contact with a pair of rails. The combination further includes a transducer positioned on an outer surface location of the rail vehicle, where the transducer emits a signal to an object located the distance away from the transducer. The transducer is configured to receive the signal having reflected from the object along the distance to the transducer. Additionally, the combination includes a controller coupled to the transducer to receive transmission and reception data of the signal to determine the distance.

Another embodiment of the present invention provides a method for measuring a distance on a railroad system. The method includes providing a rail vehicle including a plurality of pairs of wheels, where the plurality of pairs of wheels are in respective contact with a pair of rails. The method further includes positioning a transducer on an outer surface location of the rail vehicle, and configuring the transducer to emit a signal to an object located the distance away from the transducer. The method further includes configuring the transducer to receive the signal having reflected from the object along the distance to the transducer, and coupling a controller to the transducer to receive transmission and reception data of the signal to determine the distance.

A kit for converting a rail vehicle from a first configuration to a second configuration, where the rail vehicle includes a plurality of pairs of wheels in respective contact with a pair of rails. The kit includes a transducer configured to be positioned on an outer surface location of the rail vehicle, to emit a signal to an object located a distance away from the transducer. The transducer is configured to receive the signal having reflected from the object along the distance to the transducer. Additionally, the kit includes a controller configured to be installed within the rail vehicle and coupled to the transducer to receive transmission and reception data of the signal to determine the distance. When the kit is installed in the rail vehicle, the rail vehicle is converted from the first configuration to the second configuration, where the second configuration has a different operational capability than the first configuration. The first configuration includes manually determining the distance, while the second configuration includes automatically determining the distance using the transducer and the controller.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
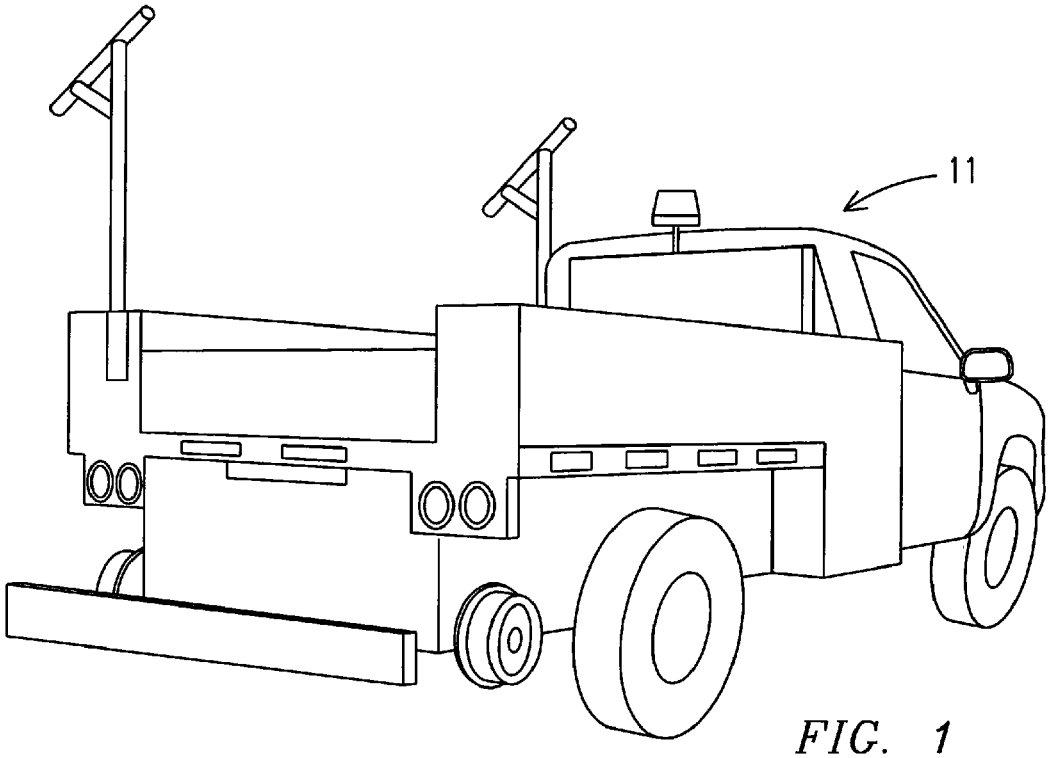
FIG. 1 (PRIOR ART)
FIG. 1 is a rear perspective view of a vehicle used in a conventional system for determining imperfections within a pair of railroad rails.
Figure 2:
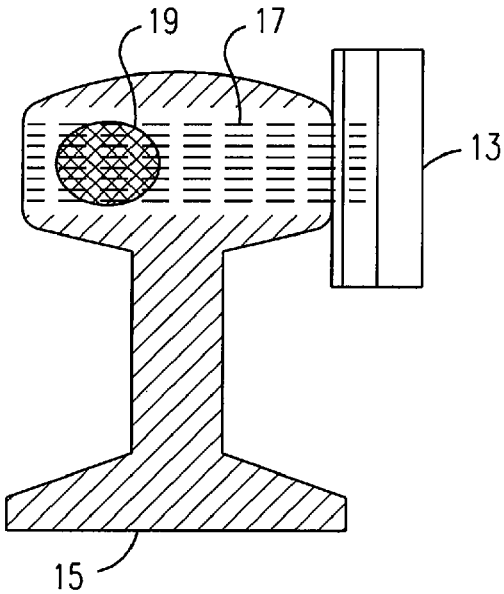
FIG. 2 (PRIOR ART)
FIG. 2 is a cross-sectional end view of a railroad rail having an imperfection detected by a conventional system for determining imperfections.
Figure 3:
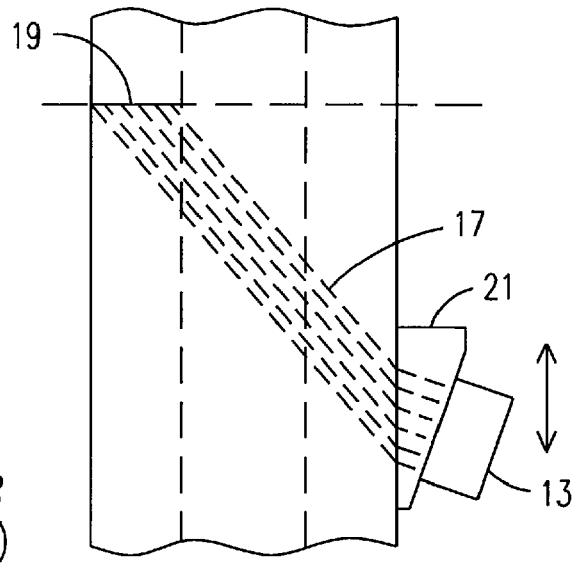
FIG. 3 (PRIOR ART)
FIG. 3 is a top plan view of a conventional system for determining imperfections within a pair of railroad rails.
Figure 4:
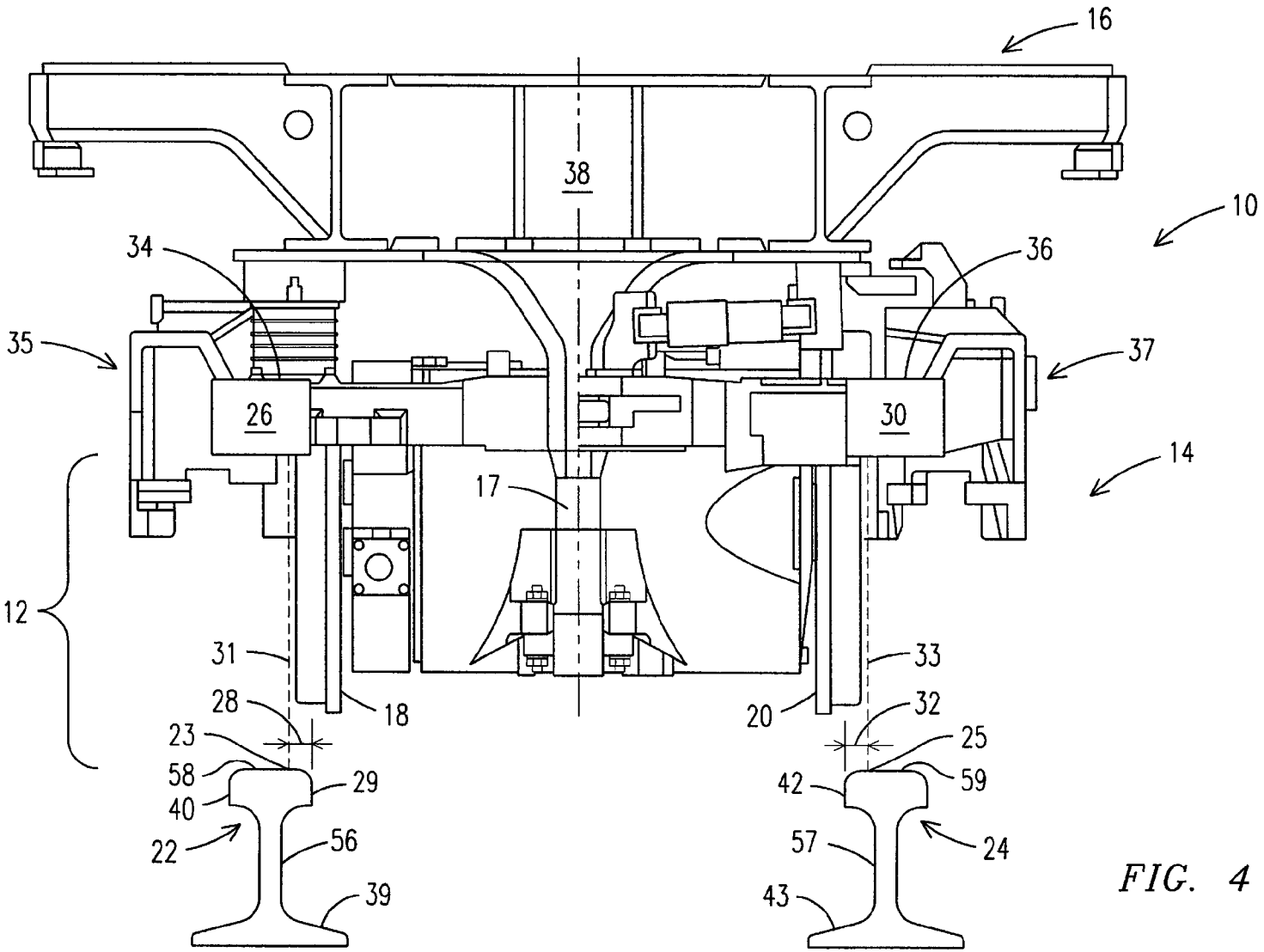
FIG. 4 is a cross-sectional end view of an exemplary embodiment of a system for measuring a distance within a railroad system.
Figure 5:
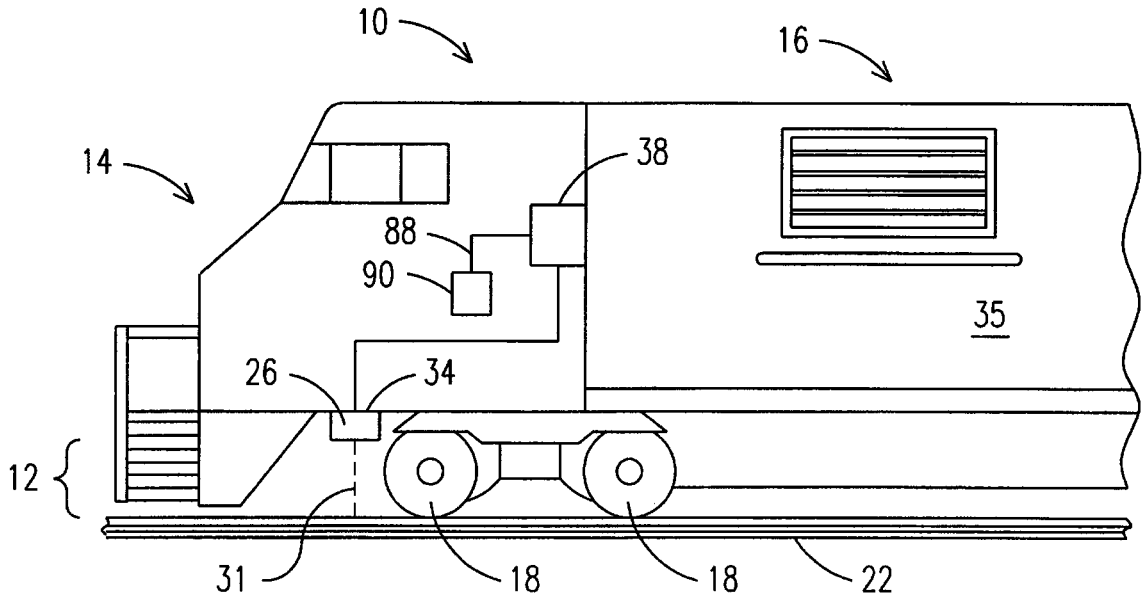
FIG. 5 is a side plan view of an exemplary embodiment of a system for measuring a distance within a railroad system.

FIGS. 4 and 5 illustrate one embodiment of a system 10 for measuring a distance 12 within a railroad system 14. In the illustrated embodiment, the railroad system 14 includes a locomotive 16 with a pair wheels 18,20 in respective contact with a pair of rails 22,24. As illustrated in FIG. 4, each respective rail includes a center vertical beam 56,57 coupled to a horizontal rail beam 58,59. However, the system 10 may be utilized in conjunction with any railroad system other than the railroad system 14 illustrated in FIG. 4, such as a railroad system without a locomotive or including additional components than those illustrated in FIG. 4.

During normal operation of the system 10, the locomotive 16 pair of wheels 18,20 are in respective contact with a pair of rails 22,24. Additionally, the locomotive 16 includes a traction motor 17, which is used to rotate the pair of wheels 18,20, as appreciated by one of skill in the art. The system 10 includes two transducers 26,30 positioned on respective outer surface locations 34,36 of the locomotive. As illustrated in the exemplary embodiment of FIGS. 4 and 5, each transducer 26,30 is respectively positioned at respective outer surface locations 34,36 corresponding to respective undersurfaces of each side 35,37 of the locomotive 16, and positioned toward a front end (not shown) of the locomotive 16. Although FIG. 5 shows a side view of the locomotive 16 from one side 35, the placement of the transducers are similar on each side 35,37 to that placement illustrated in FIG. 5. Each transducer 26,30 is positioned at the respective undersurface 34,36, above each respective rail 22,24. More particularly, each transducer 26,30 is positioned at the respective undersurface 34,36 to be aligned with and above an inner edge portion 23,25 of the respective rail 22,24, as discussed below. Although FIG. 4 illustrates a particular placement for each transducer 26,30, the transducers 26,30 may be positioned at any location along the outer surface of the locomotive. Additionally, although FIG. 4 illustrates two transducers 26,30, any number of transducers may be utilized with an embodiment of the present invention, provided that such transducers provide sufficient data to determine the measured distance, as described below. In an exemplary embodiment of the present invention, the outer surface locations, such as the undersurfaces 34,36, where each transducer 26,30 are positioned, may be an outer surface with minimal vibration during normal operating conditions of the locomotive.

The transducers 26,30 are individually configured to emit a plurality of signals 31,33 to the respective rails 22,24 which are located the distance 12 away from the respective transducer 26,30. In an exemplary embodiment of the system 10, a transducer 26 may be positioned on an outer portion of a locomotive wheel, and the distance 12 may be the diameter of the locomotive wheel, for example. Additionally, the transducers 26,30 are configured to receive the plurality of signals 31,33 having reflected from the respective rails 22,24 along the distance 12 and back to the transducers 26,30. Additionally, although FIG. 4 involves determining the distance 12 from the transducer 26,30 to the respective rails 22,24, the system 10 may be utilized to determine the distance from the transducer 26,30 to any object, other than the rails 22,24, depending on the particular application of the system 10. The respective transducer 26,30 is aligned to direct the respective signals 31,33 toward the respective inner edge portion 23,25 of each respective rail 22,24. As illustrated in FIG. 4, each respective inner edge portion 23,25 is positioned a first threshold distance 28 outward from an inner edge 29 of the rail 22, and a second threshold distance 32 outward from an inner edge 42 of the rail 24. Additionally, in an exemplary embodiment of the system 10, the transducer is an ultrasonic transducer, where each signal 31,33 is a high frequency pulse having a frequency greater than 25 kHz, for example. However, any transducer, or device to emit and receive a signal that can supply data to the controller for determining the distance may be utilized.

Although FIGS. 4 and 5 illustrate an embodiment in which each transducer 26,30 is utilized to determine a distance between the transducer and the respective inner edge portion 23,25 of the respective rail 22,24, the transducer 26,30 may be positioned adjacent to a back end or front end of the locomotive 16 as the locomotive respectively moves backward or forward, such that the transducer 26,30 determines a distance between the back end or front end of the locomotive and an obstruction object in the railway, for example. In this exemplary embodiment of the system 10, a transducer 26 would be orientated in the direction of travel of the locomotive.

Figure 6:
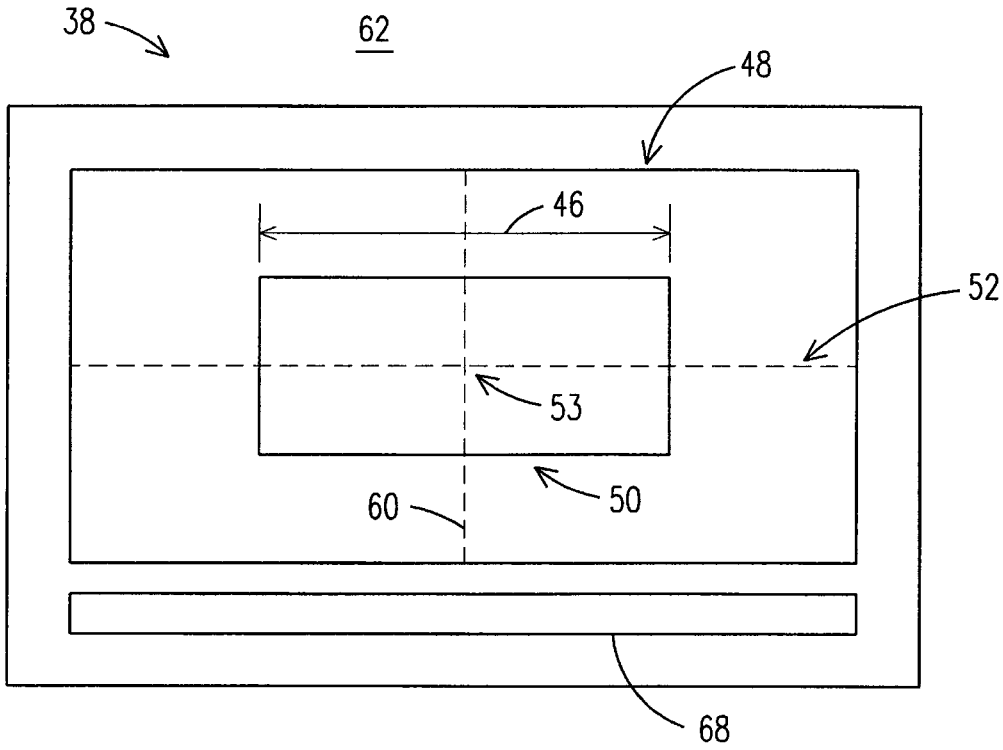
FIG. 6 is a spatial diagram of an image of a railroad rail generated with an exemplary embodiment of a system for measuring a distance within a railroad system.

As illustrated in FIGS. 4 and 5, the system 10 further includes a controller 38 coupled to each respective transducer 26,30 to receive transmission and reception data of the respective signals 31,33 to determine the distance 12 between each respective transducer 26,30 and the respective inner edge portion 23,25 of the respective rail 22,24. Each transducer 26,30 is aligned with the respective inner edge portion 23,25 of the respective rail 22,24 when the locomotive is stationary, and, once the locomotive begins to move along the rails, the respective transducer 26,30 emits a plurality of signals 31,33 along the distance 12 from the respective transducer 26,30 in the direction of the respective inner edge portion 23,25. If the horizontal rail beam 58,59 of the respective rail 22,24 has not outwardly shifted by more than the first and second threshold distances 28,32 between the inner edge portion 23,25 and the inner edge 29,42, the respective transducer 26,30 will receive the reflected signals 31,33 from the inner edge portion 23,25 and provide this transmission and reception data to the controller 38. However, if the horizontal rail beam 58,59 of the respective rail 22,24 has outwardly shifted by more than the respective first threshold distance 28 and second threshold distance 32 between the inner edge portion 23,25 and the inner edge 29,42, the signals 31,33 will pass the inner edge 29,42 and reflect from a surface 39,43 below the inner edge portion 23,25 to the respective transducer 26,30, and the respective transducer 26,30 will provide this transmission and reception data to the controller 38. In the event that a respective horizontal rail beam 58,59 of the respective rail 22,24 outwardly shifts by more than the respective first and second threshold distances 28,32, the respective transducer 26,30 will provide transmission and reception data to the controller 38 indicative of a distance greater than the transmission and reception data in the absence of such an outward shift. For example, in an exemplary embodiment of the present invention, if the transducers 26,30 provide transmission and reception data to the controller 38 which is indicative of a 15 inch distance between the respective transducer 26,30 and the horizontal rail beam 58,59, an outward shift of a respective horizontal rail beam 58,59 by more than the respective first and second threshold distances 28,32 may cause the transmission and reception data provided to the controller 38 to indicate a 20 inch distance between the respective transducer 26,30 and the surface 39,43. As illustrated in FIG. 6, a control panel 68 may be utilized for shifting a calibrated dimensional image 50 of the rail 22 (and subsequent images) on a display 48, in addition to inputting parameters, such as a fixed width 46 of a rail 22, for example, as discussed below.

Figure 7:
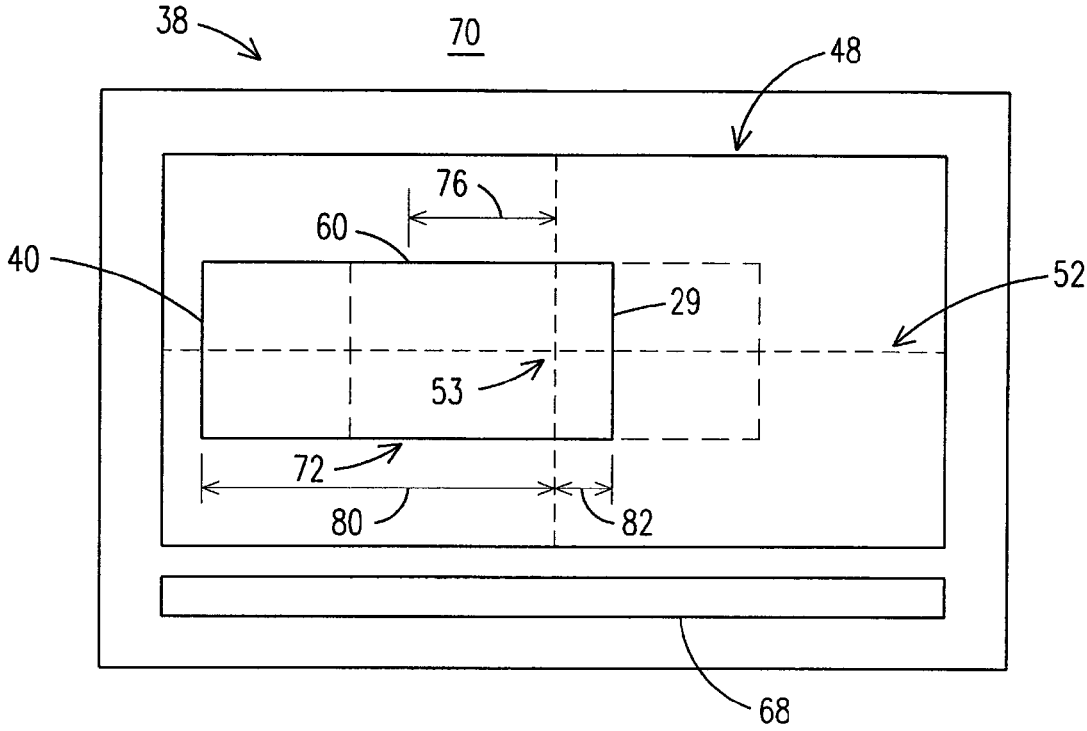
FIG. 7 is a spatial diagram of an image of a railroad rail generated with an exemplary embodiment of a system for measuring a distance within a railroad system.

The controller 38 is switchable between a calibration mode 62 (FIG. 6) and a monitoring mode 70 (FIG. 7). The controller 38 is configured to switch into the calibration mode 62 (either manually on an operator control-panel or automatically) prior to the commencement of a trip by the locomotive 16. As illustrated in FIG. 6, upon switching into the calibration mode 62, the controller 38 includes a display 48, where the display 48 shows a calibrated dimensional image 50 of the horizontal rail beam 58 based upon transmission and reception data of the signals 31 emitted from and received by the transducer 26. As illustrated in FIG. 6, the display 48 includes a fixed coordinate axis 52, with a center 53, or an origin, at the intersection of the fixed coordinate axis 52. The controller 38 utilizes the transmission and reception data from the transducer 26 to determine each respective distance for each respective signal 31 reflected from the inner edge portion 23 (if the inner edge portion 23 is aligned with the transducer 26) or from a surface 39 beneath the horizontal rail beam 58 (if the inner edge portion 23 is misaligned with the transducer 26 caused by a lateral outward shift of the rail 22 by more than the first threshold distance 28). Thus, if the controller 38 determines a distance between the transducer 26 and the surface 39, the calibrated dimensional image 50 will be shifted on the display 48 by the first threshold distance 28 that the rail 22 has shifted. Although FIG. 6 illustrates the display 48 with a calibrated dimensional image 50 of the horizontal rail beam 58 generated with transmission and reception data from the transducer 26, a similar dimensional image of the horizontal rail beam 59 would be generated with transmission and reception data from the transducer 30, also in conjunction with the fixed coordinate axis 52.

During the calibration mode 62, the transducer 26 is aligned with the inner edge portion 23 so that the signals 31 reflect from the inner edge portion 23 of the horizontal rail beam 58, and the controller 38 receives transmission and reception data of the distance 12 between the transducer 26 and the inner edge portion 23 of the horizontal rail beam 58. Upon switching the controller 38 into the calibration mode 62, a calibrated dimensional image 50 of the rail 22 on the display 48 is aligned with a center portion 60 of the horizontal rail beam 58 positioned at the center 53 of the fixed coordinate axis 52 using the control panel 68 of the display 48. A fixed width 46 of the rail 22 is input into the control panel 68, and the controller 38 displays the calibrated dimensional image 50 of the rail 22, and locates the center portion 60 of the horizontal rail beam 58 on the calibrated dimensional image 50, based on the inputted fixed width 46 of the rail and the transmission and reception data received from the transducer 26 aligned above the inner edge portion 23. Thus, the operator of the locomotive 16 switches the controller 38 into the calibration mode 62 using the control panel 68, prior to commencement of the trip by the locomotive 16. Upon switching the controller 38 into the calibration mode 62, the operator manually shifts the relative position of the calibrated dimensional image 50 with the fixed coordinate axis 52 until the center portion 60 of the horizontal rail beam 58 aligns with the center 53 of the fixed coordinate axis 52. Although FIG. 6 illustrates a center 53 of the fixed coordinate axis 52 aligned with the calibrated dimensional image 50, the calibrated dimensional image may be aligned with any fixed location of the fixed coordinate axis 52.

Figure 8:
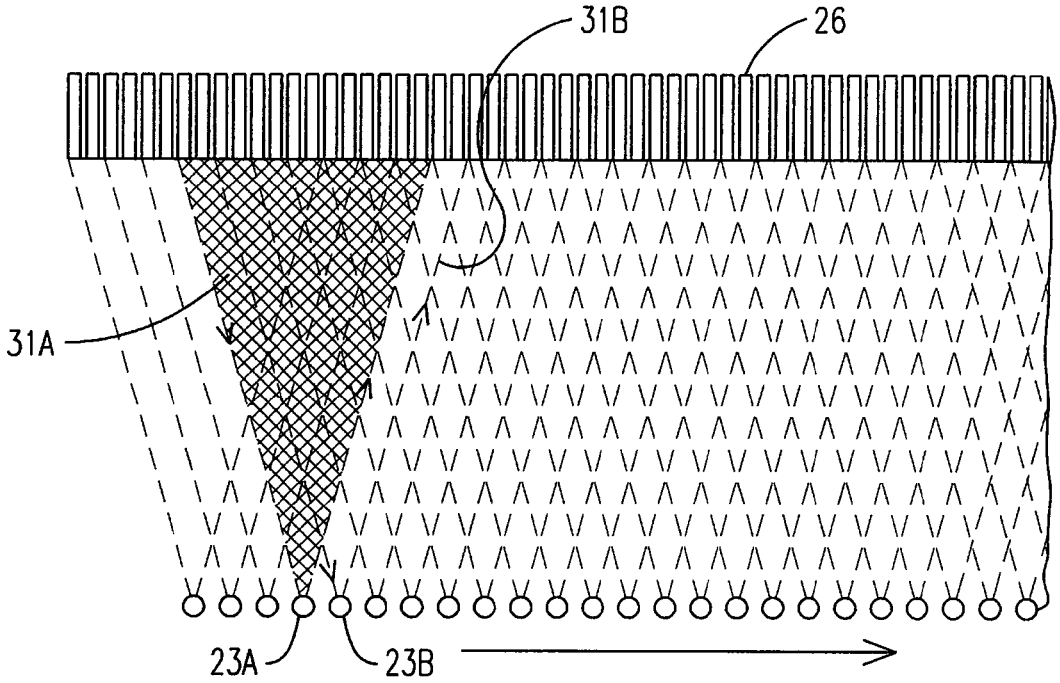
FIG. 8 is a spatial diagram along a pair of railroad rails of an exemplary embodiment of a system for measuring a distance within a railroad system utilizing a phased-array of signals from a transducer over the distance.

Once the calibrated dimensional image 50 is centered at the center 53 of the fixed coordinate axis 52 of the display 48, the controller 38 may be switched into a monitoring mode 70, and this switching may occur manually by the operator using the control panel 68, or automatically. In the monitoring mode 70, the controller 38 is configured to activate the transducer 26 to emit signals 31 as the locomotive 16 propels along the track. As the locomotive 16 propels along the track, and the transducer 26 begins the locomotive trip aligned with the inner edge portion 23, the signals 31 may continue to reflect from the inner edge portion 23, or a position along the horizontal rail beam 58 between the inner edge 29 and the inner edge portion 23, for example. However, as discussed above, if the horizontal rail beam 58 outwardly shifts by more than the first threshold distance 28, the signals 31 will pass by the horizontal rail beam 58 to the surface 39 below the horizontal rail beam 58 and the transducer 26 will provide transmission and reception data to the controller 38 indicative of a longer distance between the transducer 26 and the surface 39. As illustrated in FIG. 8, as the locomotive 16 propels along the track, a first signal 31A is emitted from the transducer 26 and reflected from a first inner edge portion 23A at a first location along the rail 22, where the emission and reflection path of the first signal 31A is highlighted in FIG. 8. When the locomotive 16 subsequently travels along the track, a second signal 31B is emitted from the transducer 26 and reflected from a second inner edge portion 23B at a second location along the rail 22. As illustrated in FIG. 7, during the monitoring mode 70, as the locomotive 16 propels along the track, the controller 38 utilizes the transmission and reception data from the transducer 26 to determine respective distances for each respective signal 31 reflected from the inner edge portion 23 of the horizontal rail beam 58 of the rail 22 (i.e., the inner edge portion 23 is aligned with the transducer 26) or a surface 39 below the horizontal rail beam 58 (the inner edge portion 23 is misaligned with the transducer 26 due to lateral outward shift of the horizontal rail beam 58 by more than the first threshold distance 28). The subsequent transmission and reception data and resulting distance measurements during the monitoring mode 70 are used to produce a subsequent dimensional image 72 of the rail 22 at a regular time interval or regular distance interval as the locomotive 16 propels along the track. However, the subsequent dimensional image 72 may be produced at non-regular time or distance intervals, for example.

Figure 9:
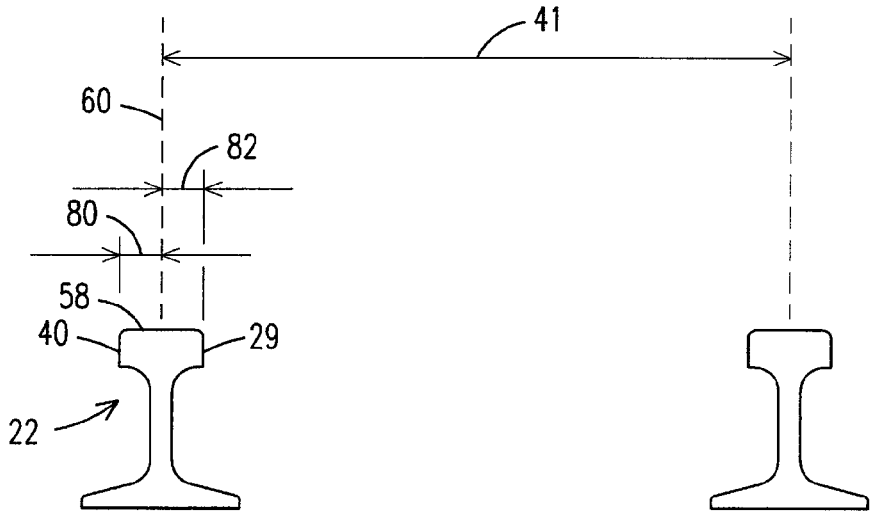
FIG. 9 is an end plan view of a pair of railroad rails of an exemplary embodiment of a system for measuring a distance within a railroad system.
Figure 10:
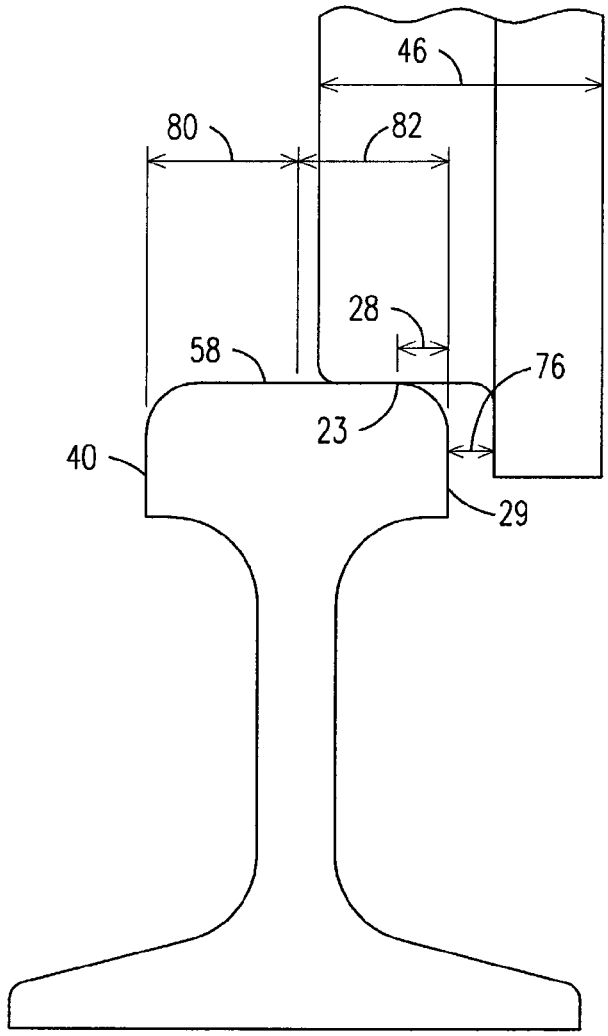
FIG. 10 is an end plan view of a pair of railroad rails and a locomotive wheel of an exemplary embodiment of a system for measuring a distance within a railroad system.

As illustrated in FIG. 7, for each subsequent transmission and reception data set and dimensional image 72 obtained during the monitoring mode 70, the controller 38 is configured to determine a rail shift 76 based upon a gap along the dimensional image 72 between the center 53 of the coordinate axis 52 (i.e., center of the horizontal rail beam 58 during the calibration mode 62) and the center portion 60 of the horizontal rail beam 58 during the monitoring mode 70. Thus, the rail shift 76 is an indication of the lateral shift of the center portion 60 of the horizontal rail beam 58, and thus also an indication of the lateral shift of the inner edge portion 23 of the horizontal rail beam 58. As further illustrated in FIG. 7, the controller 38 is further configured to determine a pair of side rail distances 80,82 indicative of a respective lateral shift of an outer edge 40 and an inner edge 29 from the calibrated center of the rail 22 coinciding with the center 53 of the coordinate axis 52, as determined in the calibration mode 62. As illustrated in FIG. 9, the rail separation 41 of the respective rails 22,24 is a fixed amount, and thus is utilized in conjunction with a fixed width 46 of the wheels 18,20 to deduce the proper placement of the respective wheels 18,20 (i.e., a lateral outward shift of the horizontal rail beam 58,59 greater than a safe threshold is not accommodated by the fixed rail separation 41). As further illustrated in FIG. 9, the side rail distances 80,82 between the center portion 60 of the horizontal rail beam 58 and the respective outer edge 40 and inner edge 29 is illustrated. During the monitoring mode 70, the controller 38 is configured to continuously monitor the rail shift 76 and side rail distances 80,82, and emit an alert signal 88 to an alert indicator 90 (FIG. 5) upon measuring a rail shift 76 and/or a side rail distance 80,82 which exceeds the first threshold distance 28. In an exemplary embodiment, the first threshold distance 28 may be one or two centimeters, for example. FIG. 10 illustrates an exemplary embodiment in which the horizontal rail beam 58 has outwardly shifted by a rail shift 76 in excess of the first threshold distance 28 between the inner edge portion 23 and the inner edge 29. Accordingly, the rail shift 76 introduces a gap between the wheel 18 (which did not outwardly shift relative to the horizontal rail beam 58) and the inner edge 29. Although FIG. 5 illustrates an alert indicator 90 which receives the alert signal 88, a wireless alert signal may be wirelessly communicated to a remote location, in order to convene a team of specialists to investigate a possible hazardous rail condition. Similarly, such a team of specialists may wirelessly communicate the possible hazardous rail condition to other locomotives that may be in the vicinity of the area. The alert indicator may be an audible indicator or visible indicator to the operator within the control panel, to alert the operator of the dangerous rail condition so that the locomotive may be stopped and/or inspected. Additionally, the alert indicator may be an automatic indicator which automatically activates a braking system of the locomotive. Those elements of the system 10, including the controller 38, which is utilized to determine whether a rail shift has exceeded a predetermined threshold may be similarly performed by an algorithm involving equivalent steps to an exemplary method of the present invention.

Figure 11:
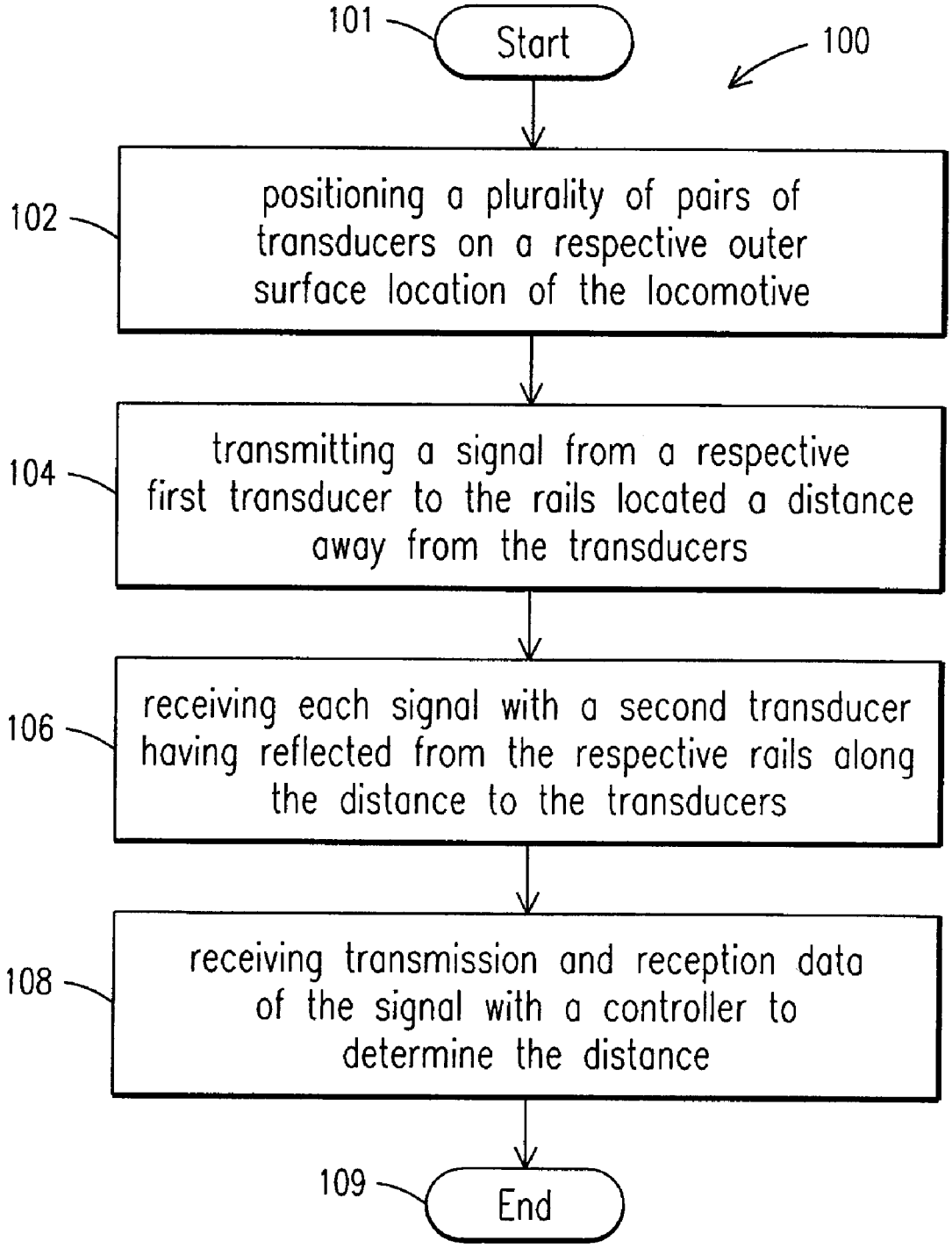
FIG. 11 is a flow chart illustrating an exemplary embodiment of a method of measuring a distance within a railroad system.

FIG. 11 illustrates an exemplary embodiment of a method 100 for measuring a distance 12 within a railroad system 14. The railroad system 14 includes a locomotive 16 with a pair of wheels 18,20, where the pair of wheels 18,20 are in respective contact with a pair of rails 22,24. The method begins at block 101 by positioning (block 102) a respective transducer 26,30 on a respective outer surface location 34,36 of the locomotive 16. The method 100 further includes emitting (block 104) a signal 31,33 from a respective transducer 26, 30 to the rails 22,24 located the distance 12 away from the transducers 26,30. The method 100 further includes receiving (block 106) each signal 31,33 with a respective transducer 26,30 having reflected from the respective rails 22,24 along the distance 12 to the transducers 26,30. The method 100 further includes receiving (block 108) transmission and reception data of the signal 31,33 with a controller 38 to determine the distance 12.

Another embodiment relates to a kit for converting a rail vehicle from a first configuration to a second configuration. The kit comprises a transducer configured to be positioned on an outer surface location of the rail vehicle. The transducer is configured to emit a signal to an object located a distance from the transducer. The transducer is configured to receive the signal having reflected from the object along the distance to the transducer. The kit also comprises a controller configured to be installed within the rail vehicle and coupled to the transducer to receive transmission and reception data of the signal to determine the distance. When the kit is installed in the rail vehicle, the rail vehicle is converted from the first configuration to the second configuration, the second configuration having a different operational capability than the first configuration. The first configuration comprises manually determining the distance, and the second configuration comprises automatically determining the distance using the transducer and the controller.

Based on the foregoing specification, the above-discussed embodiments of the invention may be implemented using computer programming or engineering techniques including computer software, firmware, hardware or any combination or subset thereof, wherein the technical effect is to measure a distance within a railroad system any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any emitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for determining whether a railroad vehicle has shifted by more than a threshold distance on a pair of rails, said system comprising:

said rail vehicle configured to travel along the pair of rails;

a transducer positioned on an outer surface location of said rail vehicle, said transducer being aligned above an inner edge portion of said respective rail to direct a signal toward said inner edge portion located a first distance from said transducer, said inner edge portion being positioned a threshold distance outward from an inner edge of said respective rail, said transducer configured to receive said signal having reflected from one of said inner edge portion along said first distance to said transducer and a surface of the respective rail beyond said inner edge portion along a second distance to said transducer, said second distance being greater than said first distance; and a controller coupled to said transducer to receive transmission and reception data of said signal to determine whether said rail vehicle has shifted by more than said threshold distance along said respective rail, based on said signal having reflected along from the surface of the respective rail along the second distance.

2. The system of claim 1, wherein said rail vehicle is a locomotive, said transducer is configured to emit a plurality of signals toward said inner edge portion, said transducer being configured to provide transmission and reception data of said signals toward said inner edge portion to said controller.

3. The system of claim 2, further comprising a display coupled to the controller, said display being configured to show a dimensional image of said inner edge portion based upon said transmission and reception data, said display including a fixed coordinate axis.

4. The system of claim 3, wherein a respective transducer is positioned at said respective outer surface location, said respective outer surface location is a respective undersurface of each side of said locomotive, said respective undersurface being positioned toward one of a front end and back end of said locomotive from said pair of wheels.

5. The system of claim 4, wherein said respective transducer is respectively aligned to direct said signals toward said pair of rails, and said rail includes a vertical beam coupled to a horizontal rail beam.

6. The system of claim 1, wherein said controller includes a calibration mode, said controller is configured to switch into said calibration mode prior to the commencement of a trip by said locomotive, such that a calibrated dimensional image of one of said plurality of rails on said display is centered with the center of said horizontal rail beam being positioned at a fixed location of a fixed coordinate axis using a control panel of said display.

7. The system of claim 6, wherein control panel is configured to input a fixed width of said respective rail, said controller is configured to display said calibrated dimensional image of said respective rail based upon said fixed width and said transmission and reception data from said respective transducer aligned above said inner edge portion.

8. The system of claim 7, wherein said controller includes a monitoring mode, said controller is configured to switch out of said calibration mode and into said monitoring mode, said controller is configured to activate said transducer to emit said plurality of signals as said locomotive propels along said pair of rails, said controller being configured to utilize said transmission and reception data obtained during said monitoring mode to determine respective distance for each respective signal as said locomotive propels along said pair of rails.

9. The system of claim 8, wherein said display is configured to show at least one subsequent dimensional image of said inner edge portion at one of a regular time interval or distance interval as said locomotive propels along said pair of rails, each subsequent dimensional image being based upon said transmission and reception data as said locomotive propels along said pair of rails.

10. The system of claim 9, wherein for said transmission and reception data and said subsequent dimensional image obtained during said monitoring mode, said controller is configured to determine a rail shift based upon a gap along said dimensional image between said fixed location of said fixed coordinate axis and said center of said horizontal rail beam.

11. The system of claim 10, wherein said controller is configured to emit an alert signal to an alert indicator upon measuring a rail shift which exceeds said respective first and second threshold distance.

12. The system of claim 11, wherein said rail shift exceeding said respective first and second threshold distance is based upon said transducer being misaligned with said inner edge portion of said respective rail during said monitoring mode, said transmission and reception data being indicative of said second distance being greater than said first distance between said transducer and said inner edge portion during said calibration mode.

13. The system of claim 1, wherein the rail vehicle includes a plurality of wheels that engage the rails for travel of the rail vehicle along the rails, said first distance is the diameter of said wheels, said outer surface location is one of an undersurface of one side of said rail vehicle or an outer portion of one of said wheels, and said transducer is oriented toward said respective rail.

14. The system of claim 1, wherein said rail vehicle propels along said pair of rails in a direction toward a back end of said rail vehicle, said distance lies between an obstruction object beyond said back end of said rail vehicle and said transducer, said outer surface location is any location adjacent to said back end, said transducer is orientated in the direction of travel of said rail vehicle, and said object is said obstruction object.

15. The system of claim 1, wherein said transducer is an ultrasonic transducer, said signal is a high frequency pulse having a frequency greater than 25 kHz.

16. A method for determining whether a railroad vehicle has shifted by more than a threshold distance on a pair of rails, said method comprising:

providing the rail vehicle configured to travel along the pair of rails;

positioning a transducer on an outer surface location of said rail vehicle;

aligning the transducer above an inner edge portion of said respective rail;

directing a signal toward the inner edge portion located a first distance from said transducer and a threshold distance outward from an inner edge of said respective rail;

receiving said signal having reflected from one of said inner edge portion along said first distance to said transducer and a surface of the respective rail beyond said inner edge portion along a second distance to said transducer; and determining whether said rail vehicle has shifted by more than said threshold distance along said respective rail, based on said signal having reflected from the surface of the respective rail along the second distance.

17. A kit for converting a rail vehicle from a first configuration to a second configuration, said rail vehicle configured to travel along a pair of rails, said kit comprising:

a transducer configured to be positioned on an outer surface location of said rail vehicle, said transducer being aligned above an inner edge portion of said respective rail to direct a signal toward said inner edge portion located a first distance from said transducer, said inner edge portion being positioned a threshold distance outward from an inner edge of said respective rail, said transducer configured to receive said signal having reflected from one of said inner edge portion along said first distance to said transducer and a surface of the respective rail beyond said inner edge portion along a second distance to said transducer, said second distance being greater than said first distance; and a controller configured to be installed within the rail vehicle and coupled to said transducer to receive transmission and reception data of said signal to determine whether said rail vehicle has shifted by more than said threshold distance along said respective rail, based on said signal having reflected along from the surface of the respective rail along the second distance;

wherein when the kit is installed in said rail vehicle, the rail vehicle is converted from the first configuration to the second configuration, the second configuration having a different operational capability than the first configuration;

wherein the first configuration comprises manually determining whether said rail vehicle has shifted by more than said threshold distance along said respective rail, said second configuration comprises automatically determining whether said rail vehicle has shifted by more than said threshold distance along said respective rail using said transducer and said controller.

* * * * *